US008651204B2

(12) United States Patent
Webb

(10) Patent No.: US 8,651,204 B2
(45) Date of Patent: Feb. 18, 2014

(54) METAL-FREE SUPPORTED POLYCRYSTALLINE DIAMOND AND METHOD TO FORM

(75) Inventor: Steven W. Webb, Worthington, OH (US)

(73) Assignee: Diamond Innovations, Inc, Worthington, OH (US)

( * ) Notice: Subject to any disclaimer, the term of this patent is extended or adjusted under 35 U.S.C. 154(b) by 305 days.

(21) Appl. No.: 12/843,286

(22) Filed: Jul. 26, 2010

(65) Prior Publication Data

US 2011/0017520 A1 Jan. 27, 2011

Related U.S. Application Data

(60) Provisional application No. 61/228,194, filed on Jul. 24, 2009.

(51) Int. Cl.

| | |
|---|---|
| ***E21B 10/46*** | (2006.01) |
| ***B23K 26/00*** | (2006.01) |
| ***B22F 7/00*** | (2006.01) |
| ***B24D 3/02*** | (2006.01) |

(52) U.S. Cl.
USPC ..... 175/434; 175/428; 175/432; 219/121.72; 419/5; 51/307; 51/309

(58) Field of Classification Search
USPC ..... 175/434, 428, 432; 219/121.72; 419/5; 51/307, 309
See application file for complete search history.

(56) References Cited

U.S. PATENT DOCUMENTS

| | | | | |
|---|---|---|---|---|
| 3,746,517 | A * | 7/1973 | Yamaya | 75/241 |
| 4,525,178 | A * | 6/1985 | Hall | 51/309 |
| 4,533,004 | A * | 8/1985 | Ecer | 175/430 |
| 4,604,106 | A * | 8/1986 | Hall | 51/293 |
| 5,512,235 | A * | 4/1996 | Cerutti et al. | 419/10 |
| 5,648,119 | A * | 7/1997 | Grab et al. | 427/249.13 |
| 6,065,552 | A | 5/2000 | Scott et al. | |
| 6,524,363 | B2 * | 2/2003 | Gates et al. | 75/231 |
| 7,090,914 | B2 * | 8/2006 | Yamagata et al. | 428/216 |
| 7,523,794 | B2 * | 4/2009 | Hall et al. | 175/374 |
| 2002/0155312 | A1 * | 10/2002 | Gates et al. | 428/551 |
| 2003/0062126 | A1 * | 4/2003 | Scaggs | 156/345.26 |
| 2004/0026132 | A1 | 2/2004 | Hall | |

(Continued)

FOREIGN PATENT DOCUMENTS

| | | |
|---|---|---|
| DE | 4437053 | 2/1996 |
| JP | 2003300778 | 10/2003 |
| WO | WO 2011011771 A2 * | 1/2011 |

OTHER PUBLICATIONS

Zhu W. et al., "Characterization of Diamond Films on Binderless W-Mo Composite Carbide", Diamond and Related Materials, Amsterdam, NL, vol. 3, No. 10, Oct. 1, 1994, pp. 1270-1276.

*Primary Examiner* — Jennifer H Gay
(74) *Attorney, Agent, or Firm* — Frank Y. Gao

(57) ABSTRACT

An cutting element incorporates a non-magnetic and electrically conductive substrate on which a layer of polycrystalline diamond particles is sintered to the substrate. An method of forming a cutting element comprises sintering the substrate, a layer of diamond particles and a catalyst source at a pressure greater than 20 kbar and a temperature greater than 1200° C. to form a layer of polycrystalline diamond particles bonded to the substrate. Cutting elements incorporating non-magnetic and electrically conductive substrates can be sectioned using ablation techniques, such as laser cutting.

19 Claims, 4 Drawing Sheets

(56) References Cited

U.S. PATENT DOCUMENTS

| | | | | |
|---|---|---|---|---|
| 2005/0050801 | A1 | 3/2005 | Cho | |
| 2007/0000875 | A1* | 1/2007 | Scaggs | 216/94 |
| 2008/0142272 | A1* | 6/2008 | Hall et al. | 175/374 |
| 2008/0206576 | A1* | 8/2008 | Qian et al. | 428/446 |
| 2010/0270088 | A1* | 10/2010 | Zhang et al. | 175/434 |
| 2010/0320004 | A1* | 12/2010 | Deng et al. | 175/426 |
| 2011/0017520 | A1* | 1/2011 | Webb | 175/428 |
| 2012/0067652 | A1* | 3/2012 | Bellin | 175/434 |
| 2012/0181090 | A1* | 7/2012 | Qian et al. | 175/428 |
| 2012/0199401 | A1* | 8/2012 | Zhang et al. | 175/428 |

* cited by examiner

METAL-FREE SUPPORTED POLYCRYSTALLINE DIAMOND AND METHOD TO FORM

TECHNICAL FIELD AND INDUSTRIAL APPLICABILITY

The present disclosure relates to blanks having a layer of integrally bonded superabrasive particles supported on sintered carbide substrates and to the sectioning by ablation techniques of such blanks. More particularly, the present disclosure relates to the composition and structure of the substrate, where, upon ablation by, for example, a laser, the ablated material does not close the cut and the cut in the substrate is maintained opened.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

Superabrasives, such as diamond, cubic boron nitride ("cBN") and polycrystalline diamond ("PCD"), have been widely used in cutting elements, such as the cutting elements in drilling, mining, and woodworking applications. In one particular application, superabrasives are incorporated into drill bits for use in rock drilling and other operations which require high abrasion resistance or wear resistance. For example, U.S. Pat. Nos. 4,109,737 and 5,374,854, the disclosures of each of which are herein incorporated by reference in their entirety, describe drill bits with a tungsten carbide substrate having a polycrystalline diamond compact on the outer surface of the cutting element.

As a cutting element, the superabrasive material forms a compact, which is a mass of diamond particles or cBN particles, bonded together to form an integral, tough, high-strength mass. Diamond or cBN particles may be bonded together as a compact in a particle-to-particle self-bonded relationship, optionally with a bonding medium disposed between the particles, such as a catalyzing material used to bond the abrasive particles together. For example, U.S. Pat. Nos. 3,236,615; 3,141,746; and 3,233,988, the disclosures of each of which are herein incorporated by reference in their entirety, describe compacts and methods of forming the same.

Although formed in a near net-shape form, cutting elements have many applications when cut to shape. Currently, electrical discharge machine ("EDM") techniques are commonly used to ablate or cut PCD or PCBN layers supported on sintered carbide substrates. It ablates using the intense heat of a hot spark. EDM cutting has a high precision, <0.008 inch kerf and results in clean cut edges. In EDM, the moving wire and water flushing effectively adheres to and then pulls away from the cut, the ablated cut material. Flushing keeps the edge cool minimizing thermal damage. However, EDM is a slow process, with cutting rates of about 5 $mm^2$/min through PCD and carbide, and is sensitive to the electrical conductivity, and spatial variation of electrical conductivity, of PCD and PCBN, which is not well controlled in synthesis. EDM is, in practice, useless for non-conducting materials like ceramics. EDM produces miles of spent wire which must be disposed.

Another technique used to ablate or cut PCD or PCBN is laser cutting. This technique is currently gaining popularity due to very high cut rates, >250 mm2/min, potentially narrow kerf width, no consumables, high precision and reasonable cut edge quality for unsupported PCD and unsupported PCBN, where unsupported indicates there is no underlying substrate of hard material, such as cemented carbide.

A major issue with laser ablation cutting of supported PCD and supported PCBN is the recondensing or recasting of metal from the carbide support and PCD back into the kerf or along the cutting edge after the laser has passed. In laser cutting, gas is directed to the cutting area, but this is ineffective in removing the condensable metal vapor. When cutting supported PCD or supported PCBN, the metal content of carbide, conventionally approximately 6-13 wt-% cobalt, results in considerable condensable metal fume being produced. PCD contains about 5 to about 20% w/w Co metal, but since the carbide support is 10 times heavier than the PCD, the majority of metal vapor derives from the carbide support. The presence of metal fume or vapor in the cut necessitates the use of an excessively wide kerf combined with grit-blasting of the cut parts after laser cutting to keep the cut open and blast off recast metal is a large labor cost and currently consumes the time benefits of laser cutting techniques as compared to EDM techniques. The grit blasted laser cut PCD material, now free of condensed cobalt metal, is obviously rougher and potentially chipped. This method cannot be used for polished PCD as the polish will be impaired.

Furthermore the condensed metal fume puts heat of vaporization of cobalt back into the PCD. This heat can oxidize and/or crack the PCD. If laser ablation is conducted in air the metal vapor can oxidize, producing even more heat which inevitably gets into the PCD material. To prevent burning and overheating the cut edge, laser cutting of supported PCD is frequently done in nitrogen gas. This does nothing to address the heat of vaporization. Eliminating the metal from the carbide, and perhaps the PCD, eliminates all this heat and produces a less defective cut part.

SUMMARY

An exemplary cutting element comprises a substrate and a layer of polycrystalline diamond particles sintered to the substrate, the layer including a working surface at a first surface distal from the substrate, wherein the substrate is non-magnetic and electrically conductive.

An exemplary method of forming a cutting element comprises positioning a substrate on a first side of a layer of diamond particles, positioning a catalyst source on a second side of the layer of diamond particles, and sintering the substrate, the layer of diamond particles and the catalyst source at a pressure greater than about 20 kbar and a temperature greater than about 1200° C. to form a layer of polycrystalline diamond particles bonded to the substrate, wherein the substrate is largely free of condensable material, non-magnetic and electrically conductive.

An exemplary method of forming a cutting element comprises a substrate and a layer of diamond particles blended with catalyst particles, the substrate and diamond-catalyst particles sintered at greater than about 20 kbar and greater than about 1200° C. to form a polycrystalline diamond bonded to the substrate, wherein the substrate, is non-magnetic, electrically conductive and is largely free of condensable material.

An exemplary method of sectioning a cutting element comprises ablating the cutting element to form a reduced shape, wherein the cutting element includes a substrate and a layer of polycrystalline diamond sintered to the substrate, and wherein the substrate is non-magnetic and electrically conductive.

It is to be understood that both the foregoing general description and the following detailed description are exemplary and explanatory and are intended to provide further explanation of the invention as claimed.

BRIEF DESCRIPTION OF THE DRAWINGS

The following detailed description can be read in connection with the accompanying drawings in which like numerals designate like elements and in which.

DETAILED DESCRIPTION

Figure 1:
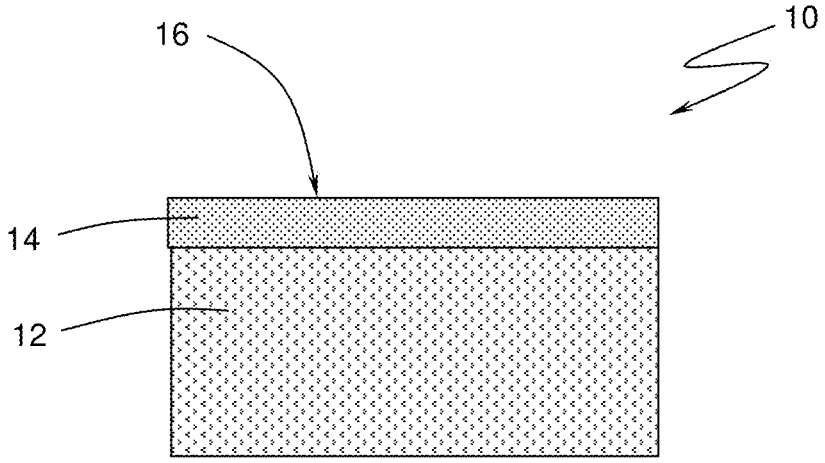
FIG. 1 is a schematic cross-sectional representation of an exemplary cutting element.

FIG. 1 is a schematic cross-sectional representation of an exemplary cutting element. The cutting element 10 comprises a substrate 12 and a layer 14 of superhard material, such as particles of diamond or of cubic boron nitride, sintered to the substrate 12. Sintering bonds the particles of the superhard material to each other as well as to the substrate, forming a layer of polycrystalline diamond particles (PCD) or a layer of polycrystalline cubic boron nitride (PCBN).

In the cutting element 10, the layer 14 of the superhard material includes a first surface 16 distal from the substrate 12 that is a working surface of the cutting element 10, i.e., the surface, at least a portion of which, contacts geological formations or workpieces during drilling or cutting operations with the cutting element. The first surface can be rectilinear or can be chamfered at one or more edges 18, as is known in the art.

Figure 2:
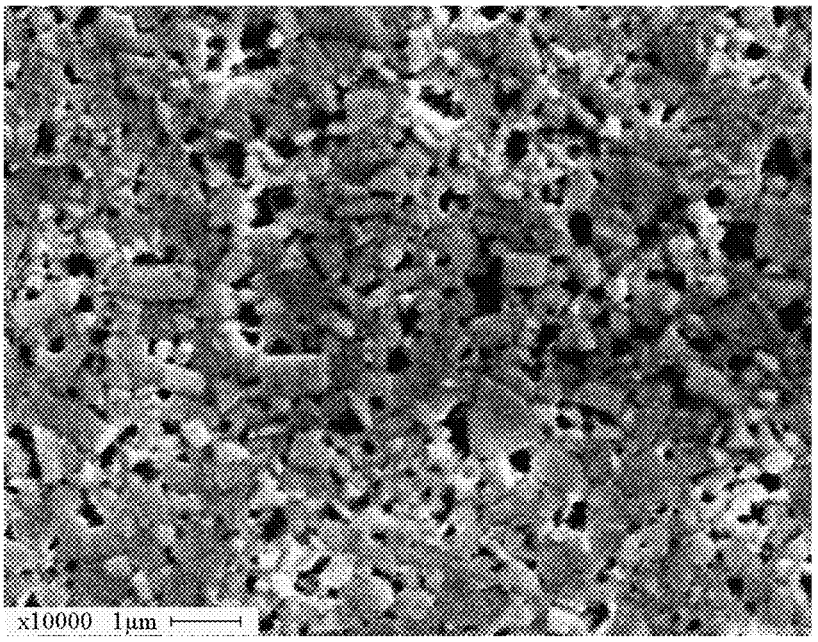
FIG. 2 is an SEM micrograph at 10,000× magnification of a surface of an exemplary embodiment of a substrate used to support a superhard material.

The substrate 12 is non-magnetic, due to low or no metal or condensable material present, and is electrically conductive, due to the presence of semiconducting WC. In an exemplary embodiment, the substrate 12 substrate has a composition including tungsten carbide and an iron group binder metal present in an amount of less than about 0.5 wt-%, alternatively, greater than 0 wt-% to less than about 0.5 wt-%, greater than 0 wt-% to less than about 0.4 wt-%, or greater than 0 wt-% to less than about 02 wt-%. In a specific exemplary embodiment, the substrate composition is free of binder metal. The composition of the substrate 12 can further optionally include a metal carbide, such as $Mo_2C$. A suitable substrate is available from North American Carbide, Buffalo, N.Y., and is a hot-pressed, WC-based body with about 0.4 wt-% cobalt metal. FIG. 2 is an SEM micrograph at 10,000× magnification of a surface of an exemplary embodiment of a substrate 12. The micrograph in FIG. 2 shows a matrix having a composition of about 99 wt-% WC and porosity of less than about 3 vol-%. The grains have an average diameter of about 1 micron.

The substrate can be incorporated into a cutting element in support of and bonded to a layer of superhard material. An example of a bonding method is sintering. In an exemplary method, a cutting element is formed by positioning a substrate on a first side of a layer of diamond particles. A catalyst source is positioned on a second side of the layer of diamond particles, as a metal alloy foil or a cermet disk, or simply blended as powder with the diamond particles. An example of a catalyst source is a material including an iron-group element. The material for the catalyst source can be in any suitable form, such as powders, particles or a solid body, layer or film. The substrate, the layer of diamond particles and the catalyst source are sintered at a pressure greater than about 20 kbar and a temperature greater than about 1200° C., also known as high pressure/high temperature (HPHT) processing (see, for example, U.S. Pat. No. 5,512,235, the entire contents of which are incorporated herein by reference, for details on conventional HPHT processes and related equipment and consumables) to form a layer of polycrystalline diamond particles bonded to the substrate. As described herein, the substrate is non-magnetic and is electrically conductive.

The cutting element can be sectioned by any ablation technique. In an exemplary method, a cutting element, including a substrate and a layer of polycrystalline diamond sintered to the substrate, is sectioned by ablating the cutting element to form a reduced shape. The substrate is non-magnetic and electrically conductive, as described herein. An example ablation technique is laser cutting. An example of a suitable laser technique uses parameters as shown in TABLE A.

TABLE A

| Laser | Rofin Sinar RS 100D |
|---|---|
| Wavelength (nm) | 1064 |
| Beam expander | 5x |
| Focal distance (nm) | F160 |
| Theoretical spot size (μm) | 20 |
| Galvohead | S14 |
| Mode aperture (mm) | 1.6, 1.6 |

Because the iron group binder metal is present in the substrate in an amount of less than about 0.5 wt-%, including up to being free of binder metal, there is an absence of recast material from the substrate in the region of the cut, for example in the kerf. This contrasts to laser cutting of a conventional substrate such as carbide, where an ablation technique such as laser cutting, if successful at all, will use grit blasting or other secondary removal method to keep the ablated metal from the substrate from recondensing or recasting, particularly in the kerf of the cut. This is a huge cost in labor and equipment and consumes the benefit of speed achieved with laser cutting vice traditional EDM.

Example 1

Diamond powder (6 micron grain size) was blended with 6 micron Fe and Ni (31% Ni; carbon-saturated melting point 1254° C.) powders and positioned on top of a 1 inch square× 0.140 inch metal-free carbide support. The metal-free carbide support was obtained from North American Carbide, Buffalo, N.Y., and is a hot-pressed, WC body with about 0.4 wt-% cobalt metal. The support is non-magnetic, due to low or no cobalt present, and conductive, due to the presence of WC. The blended powder on metal-free carbide was placed within a conventional PCD support comprising conventional carbide support. This arrangement was used to evaluate the behavior of the metal-free carbide relative to conventional carbide.

Figure 3:
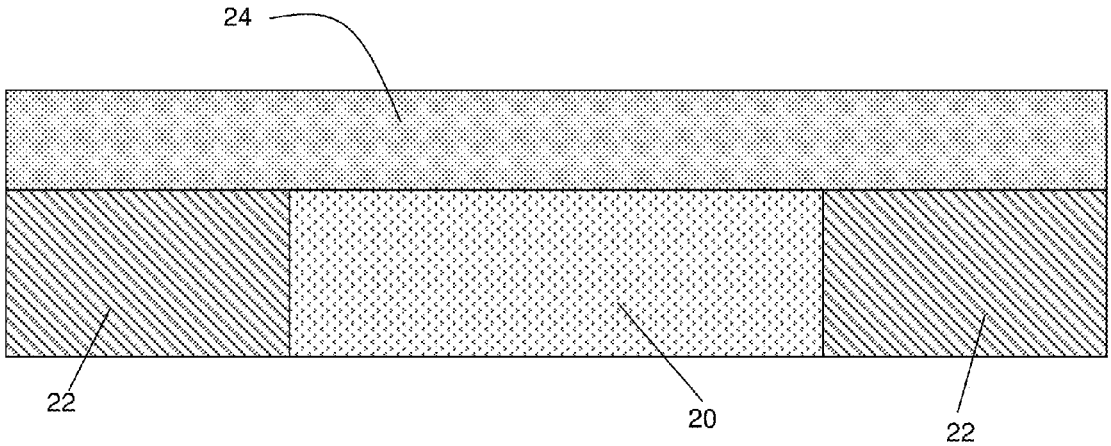
FIG. 3 is a diagram of one experimental variation in which the catalyst is supplied via a powder and the substrate is a combination of conventional and -metal-free carbide.

FIG. 3 shows a schematic of the arrangement, including the metal-free carbide support 20, the conventional carbide 22 and the blended powder 24. The assembly was sintered in a conventional high pressure/high temperature (HPHT) arrangement at about 1450° C. (melting point of cobalt catalyst in conventional carbide is 1369° C.) and about 55 kbar for about 13 minutes. Details of conventional HPHT processes and related equipment and consumables can be found in U.S. Pat. No. 5,512,235, the entire contents of which are incorporated herein by reference.

The formed PCD cutting element was cut out of the PCD blank and ground on all sides to reveal the metal-free carbide substrate and PCD layer bonded to it. The formed cutting element had good integrity and was not cracked; indicating that the coefficient of thermal expansion, adhesion, bend strength, impact toughness and heat-tolerance of metal-free carbide is compatible with PCD. For reference, the coefficient of thermal expansion of metal-free carbide is about 4.5 ppm/K while the coefficient of thermal expansion of conventional carbide with about 13 wt-% Co is about 7.5 ppm/K, the coefficient of thermal expansion of cBN, diamond and B4C is about 3 ppm/K, the coefficient of thermal expansion of PCD is about 5.5 ppm/K, the coefficient of thermal expansion of PCBN is about 5 ppm/K, and the coefficient of thermal expansion of Co is about 12 ppm/K. Accordingly, one can see that there is better matching of the coefficient of thermal expansion between metal-free carbide (4.5 ppm/K) and PCD (5.5 ppm/K) than there is between conventional carbide (7.5 ppm/K) and PCD (5.5 ppm/K). Moreover, because the coefficient of thermal expansion for metal-free carbide is less than the coefficient of thermal expansion for PCD (4.5 ppm/K<5.5 ppm/K), the stresses in a cutting element arising from the difference in the coefficient of thermal expansion of these materials places the PCD in compression and the substrate in tension at the interface. PCD is stronger in compression than in tension, so the overall integrity of the cutting element is improved.

Table 1 shows the element analysis (XRF) of the PCD layer above the metal-free carbide, above conventional carbide, and of the metal-free carbide after sintering. Melt cobalt catalyst has infiltrated from the conventional carbide into the metal-free carbide and into the PCD layer, displacing melt Fe and Ni. Furthermore, Fe and Ni from the diamond layer infiltrated the metal-free carbide. There is no change in the cobalt content of metal-free carbide before and after sintering. This is an indication that metal-free carbide (WC) is porous, attracts melt FeNi much more than cobalt, and attracts melt FeNi more than diamond.

TABLE 1

| | Location (1) | Location (2) | Location (3) |
|---|---|---|---|
| Ni | 2.1 | 4.2 | 1.4 |
| W | 4.3 | 5.5 | 93.1 |
| Co | 9.4 | 6.3 | 0.43 |
| Fe | 11.7 | 10.4 | 4.31 |

Example 2

To supply melt cobalt catalyst of a suitable chemistry for sintering diamond powder, a 0.020" thick disk of conventional carbide, comprising 13 wt-% cobalt was placed on one side of a compacted layer of 6 micron diamond powder. This melt cobalt is known to make good PCD. On the other side was placed 0.120" thick disk of metal-free carbide. This "sandwich" arrangement was compacted and sealed in a Ta metal cup and then sintered at HPHT conditions per the method of Example 1. The sintered blank was ground on all sides. The carbide side was removed to reveal the PCD. The metal-free carbide was left to act as a substrate. The resulting blank was conductive and EDM cut to form a cutting tool edge. The blank was laser cut at >300 $mm^2$/min with no issue with recast metal. The laser was as described above. There was a small amount of metal from the PCD layer cast on the edge that could be wiped off with an abrasive cloth. Grit blasting was not required. There was no chipping and minimal heat-affected-zone due to recast metal.

Example 3

The part from Example 1 was placed in boiling 6M HCl acid for one hour to dissolve the catalyst metal from the PCD. The leached part was non-conductive and had <0.5 wt-% metal based on XRF (see Table 2). Completely removing the metal did not delaminate the metal-free carbide from the PCD nor generate new defects in the PCD nor destroy the metal-free carbide substrate. The piece was laser cut at high speed>350 $mm^2$/min with no recast metal.

TABLE 2

| | Unleached | Leached |
|---|---|---|
| Ni | 1.8 | 0.4 |
| W | 3.8 | 3.2 |
| Co | 7.8 | 0.65 |
| Fe | 4.5 | 0.91 |

As an alternative, only some of the catalyst metal can be removed by, for example, leaching for a suitable shorter time period, as disclosed, for example, in U.S. Pat. No. 4,224,380, the entire contents of which are incorporated herein by reference.

Example 4

The sandwich arrangement of Example 2 was repeated with 0.080" of conventional carbide and 0.060" of metal-free carbide around the same 6 micron diamond powder. It was sealed and sintered in the identical HPHT process. The sintered blank delaminated in several places within the PCD layer indicating this arrangement is unfavorable for supplying melt catalyst to the diamond layer due to the coefficient of thermal expansion of carbide and thickness of the carbide catalyst layer.

Figure 4:
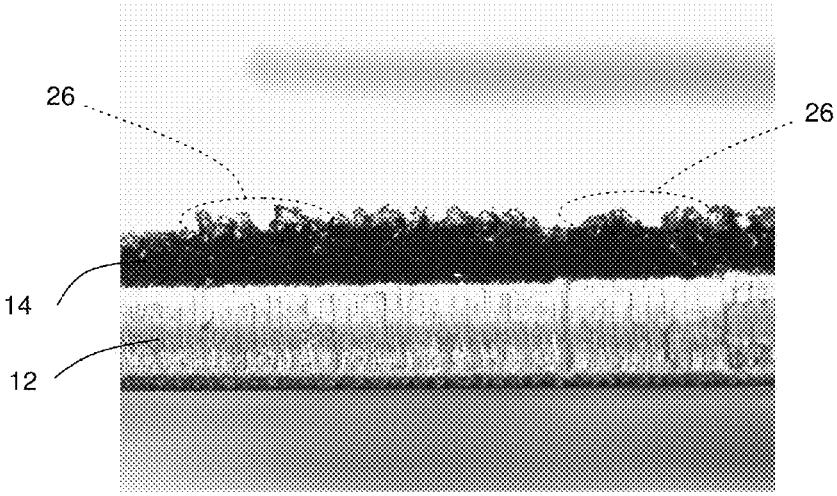
FIG. 4 is an image of the formed cutting element in Example 1.

A formed cutting element consistent with that produced in Example 1 and having a PCD layer thickness of 1 mm and a substrate thickness of 3.5 mm was laser cut using the above laser parameters. The cut rate of the laser cutting was in excess of 200 $mm^2$/min, which was the maximum for the equipment. It was estimated that the maximum cut rate is approximately 300 $mm^2$/min to approximately 400 $mm^2$/min. FIG. 4 is an image of a cross-section of the cutting element showing the cut surface where the substrate 12 and layer 14 have been sectioned by a laser. Note that at the substrate there is no recast metal. There is some recast metal 26 above the PCD, but this arises from the binder in the PCD layer, which was 13 wt-% Co. The figure clearly shows that the laser cutting was not an issue with respect to the substrate.

Figure 5:
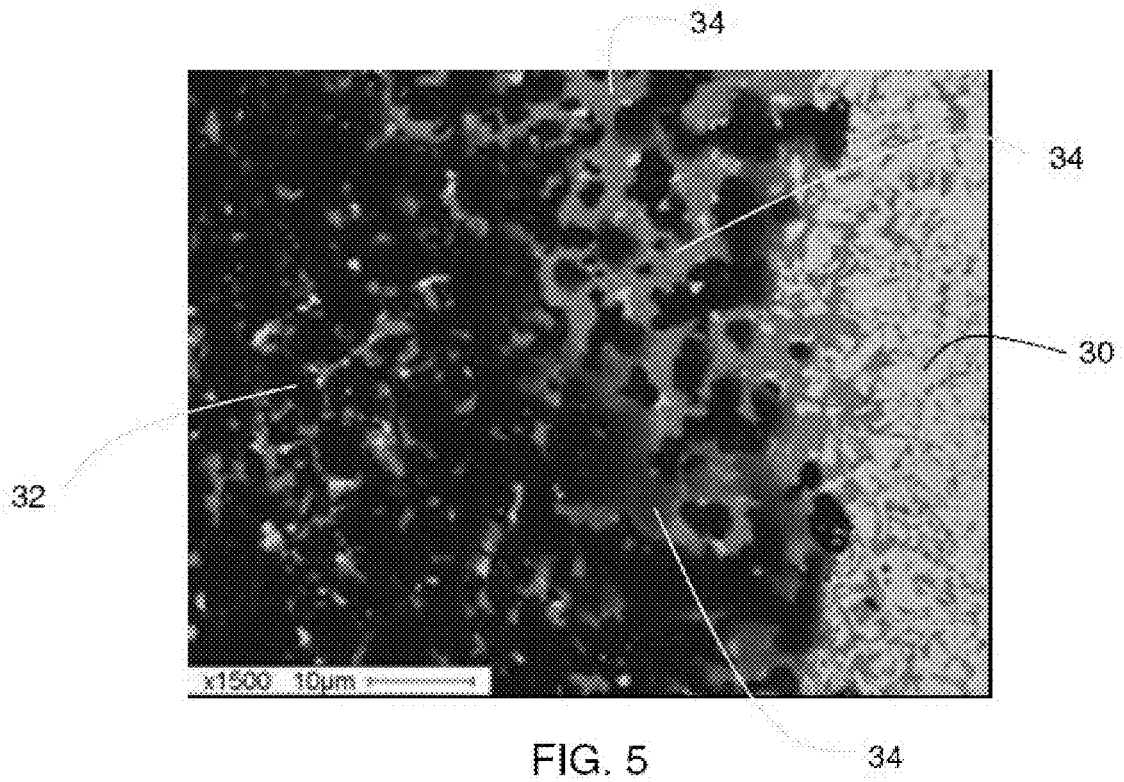
FIG. 5 is an image of a cross-section of the cutting element in Example 1 showing the cut surface where the substrate and layer have been sectioned by a laser.

FIG. 5 is an SEM micrograph at 1,500× magnification of the region of the bond between a superhard material and a metal-free carbide substrate on which the superhard material is supported. The adhesion between metal-free carbide substrate 30 and PCD 32 is made by catalyst Co 34 from the PCD layer interacting with the carbide forming a carbon-carbide liquid-phase sintered solid-state bond. When or if the metal catalyst is removed, by for example leaching, the bond strength persists.

Comparative Example

Figure 6:
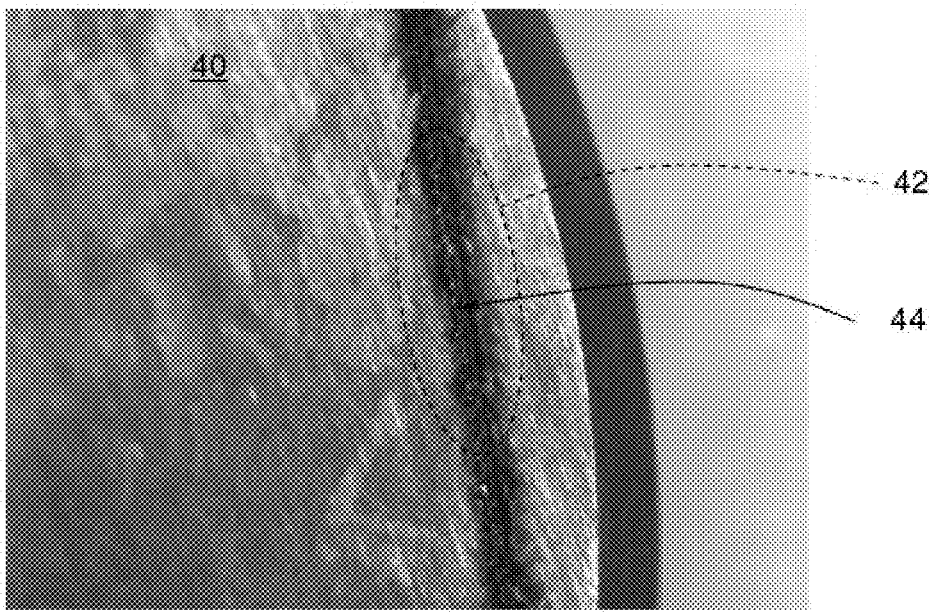
FIG. 6 is a top-view image of the laser cut conventional carbide disk showing complete lack of separation.
Figure 7:
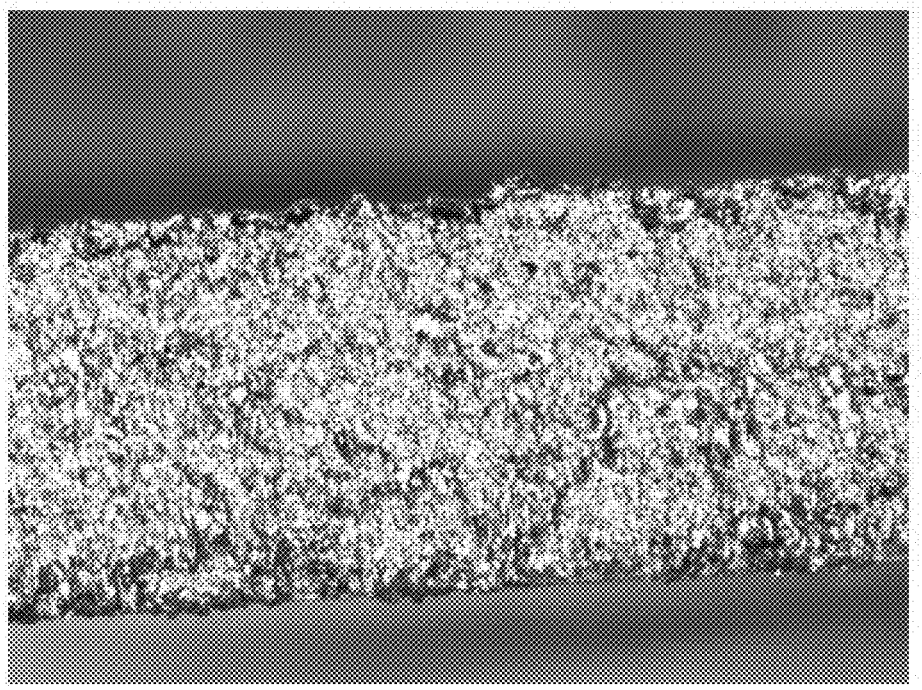
FIG. 7 is a side-image of the cross section of the laser cut metal-free carbide, showing the clean separation and good edge quality.

FIG. 6 is a top view image of a conventional carbide that includes a binder metal, in this case Co 13 wt-%. The sample 40 was laser cut using the identical parameters as in Example 1. In the region of the cut 42, one observes a dense metal refill 44 due to the metal from the substrate recasting into the cut. Above the cut, there is a stacked feature of slag. Separation of the carbide did not occur as the recast metal effectively rewelded the parts together as the laser traversed. FIG. 7 shows a cross-section of metal-free carbide laser cut at identical conditions revealing a clean cut edge with no recast metal.

Compared to the cut for Example 1 shown in FIG. 4 and FIG. 7, the cut in the comparative example requires substantial post-cut processing, including removal of the stacked feature of slag, e.g., by grit blasting, and, once the section is separated, a cleaning operation on the cut surfaces themselves, e.g., grinding or blasting Although described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A cutting element, comprising:

a substrate; and a layer of superhard particles sintered to the substrate, the layer including a working surface at a first surface distal from the substrate, wherein the substrate is non-magnetic and electrically conductive in such that there is substantially free of a recast metal from the substrate after a laser cut wherein the layer of superhard particles has an iron group binder metal, wherein the iron group binder metal infiltrates from the layer of superhard particles into the substrate.

2. The cutting element of claim 1, wherein the superhard particles are selected from the group of polycrystalline diamond particles or cBN particles.

3. The cutting element of claim 1, wherein the substrate has a composition including tungsten carbide and an iron group binder metal present in an amount of less than about 0.5 wt-%.

4. The cutting element of claim 3, wherein the iron group binder metal is present in an amount of greater than zero wt-%.

5. The cutting element of claim 3, wherein the composition of the substrate is free of binder metal.

6. The cutting element of claim 3, wherein the composition further includes a metal carbide.

7. A method of forming a cutting element, the method comprising:

positioning a substrate on a first side of a layer of diamond particles;

positioning a catalyst source on a second side of the layer of diamond particles; and sintering the substrate, the layer of diamond particles and a catalyst source at a pressure greater than 20 kbar and a temperature greater than 1200° C. to form a layer of polycrystalline diamond particles bonded to the substrate, wherein the substrate is non-magnetic and electrically conductive in such that there is substantially free of a recast metal from the substrate after being sectioned via an ablation technique, wherein the layer of superhard particles has a binder metal, wherein the binder metal infiltrates from the layer of superhard particles into the substrate.

8. The method of claim 7, wherein the substrate has a composition including tungsten carbide and an iron group binder metal present in an amount of less than about 0.5 wt-%.

9. The method of claim 8, wherein the iron group binder metal is present in an amount of greater than zero wt-%.

10. The method of claim 8, wherein the composition of the substrate is free of binder metal.

11. The method of claim 8, wherein the composition further includes a metal carbide.

12. A method of sectioning a cutting element, the method comprising:

ablating the cutting element to form a reduced shape, wherein the cutting element includes a substrate and a layer of superhard particles sintered to the substrate, and wherein the substrate is non-magnetic and electrically conductive.

13. The method of claim 12, wherein the superhard particles are selected from the group of polycrystalline diamond particles and cBN particles.

14. The method of claim 12, wherein ablating includes laser cutting.

15. The method of claim 14, wherein there is an absence of recast material from the substrate in the region of the cut.

16. The method of claim 12, wherein the substrate has a composition including tungsten carbide and an iron group binder metal present in an amount of less than about 0.5 wt-%.

17. The method of claim 16, wherein the iron group binder metal is present in an amount of greater than zero wt-%.

18. The method of claim 16, wherein the composition of the substrate is free of binder metal.

19. The method of claim 16, wherein the composition further includes a metal carbide.

* * * * *